US011619030B2

(12) United States Patent
Misaki

(10) Patent No.: US 11,619,030 B2
(45) Date of Patent: Apr. 4, 2023

(54) SHOVEL HAVING BOOM RAISING ASSISTING FUNCTION USING ATTACHMENT INFORMATION

(71) Applicant: SUMITOMO(S.H.I) CONSTRUCTION MACHINERY CO., LTD., Tokyo (JP)

(72) Inventor: Youji Misaki, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 883 days.

(21) Appl. No.: 16/558,708

(22) Filed: Sep. 3, 2019

(65) Prior Publication Data

US 2019/0390444 A1 Dec. 26, 2019

Related U.S. Application Data

(63) Continuation of application No. PCT/JP2018/009089, filed on Mar. 8, 2018.

(30) Foreign Application Priority Data

Mar. 10, 2017 (JP) ..... JP2017-046769

(51) Int. Cl.
*E02F 9/26* (2006.01)
*E02F 9/22* (2006.01)
(Continued)

(52) U.S. Cl.
CPC ..... *E02F 9/265* (2013.01); *E02F 9/2282* (2013.01); *E02F 9/2285* (2013.01);
(Continued)

(58) Field of Classification Search
CPC ..... E02F 3/40; E02F 9/2235; E02F 9/265
See application file for complete search history.

(56) References Cited

U.S. PATENT DOCUMENTS 5,682,311 A * 10/1997 Clark ..... E02F 3/435 701/50
5,933,346 A * 8/1999 Brabec ..... E02F 9/2025 340/684
(Continued)

FOREIGN PATENT DOCUMENTS

EP 2532793 12/2012
EP 3040237 7/2016
(Continued)

OTHER PUBLICATIONS

International Search Report for PCT/JP2018/009089 dated May 22, 2018.

*Primary Examiner* — Thomas E Lazo
(74) *Attorney, Agent, or Firm* — IPUSA, PLLC

(57) ABSTRACT

A shovel includes a lower traveling body, an upper turning body turnably mounted on the lower traveling body, a cab mounted on the upper turning body, an attachment including a boom attached to the upper turning body, a boom cylinder configured to drive the boom, a control device configured to control hydraulic oil flowable into the boom cylinder, and an information obtaining device configured to obtain information on the attachment. The control device is configured to increase the pressure of hydraulic oil flowable into the boom cylinder in accordance with the information on the attachment before a boom raising operation is performed.

11 Claims, 11 Drawing Sheets

(51) Int. Cl.
*E02F 3/30* (2006.01)
*E02F 3/40* (2006.01)

(52) U.S. Cl.
CPC ..... *E02F 9/2292* (2013.01); *E02F 9/262* (2013.01); *E02F 3/303* (2013.01); *E02F 3/40* (2013.01)

(56) References Cited

U.S. PATENT DOCUMENTS

| | | | | |
|---|---|---|---|---|
| 9,556,583 | B2 * | 1/2017 | Guo | E02F 9/2025 |
| 2011/0004378 | A1 * | 1/2011 | Saito | E02F 9/2083<br>701/50 |
| 2012/0246981 | A1 * | 10/2012 | Magaki | E02F 9/2075<br>414/685 |
| 2012/0315119 | A1 * | 12/2012 | Magaki | E02F 3/43<br>414/815 |
| 2013/0345939 | A1 * | 12/2013 | Magaki | E02F 3/435<br>701/50 |
| 2017/0292241 | A1 * | 10/2017 | Magaki | E02F 9/2075 |

FOREIGN PATENT DOCUMENTS

| | | | | |
|---|---|---|---|---|
| JP | 2013-185416 | | 9/2013 | |
| JP | 2014-005711 | | 1/2014 | |
| WO | 2016/104016 | | 6/2016 | |
| WO | WO-2016104016 | A1 * | 6/2016 | B60R 11/06 |

* cited by examiner

SHOVEL HAVING BOOM RAISING ASSISTING FUNCTION USING ATTACHMENT INFORMATION

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2018/009089, filed on Mar. 8, 2018 and designating the U.S., which claims priority to Japanese patent application No. 2017-046769, filed on Mar. 10, 2017. The entire contents of the foregoing applications are incorporated herein by reference.

BACKGROUND

Technical Field

The present invention relates to shovels.

Description of Related Art

Shovels with an excavation attachment composed of a boom, an arm, and a bucket have been known. The boom, the arm, and the bucket are hydraulically driven by a boom cylinder, an arm cylinder, and a bucket cylinder, respectively. A shovel operator, for example, excavates soil by closing the arm and thereafter lifts the excavated soil by raising the boom. During excavation, the flow area of a conduit through which hydraulic oil flowing out of or into the arm cylinder passes is preferably large. This is because it is possible to control generation of unnecessary pressure loss in the conduit and increase the closing speed of the a.m.

SUMMARY

According to an aspect of the present invention, a shovel includes a lower traveling body, an upper turning body turnably mounted on the lower traveling body, a cab mounted on the upper turning body, an attachment including a boom attached to the upper turning body, a boom cylinder configured to drive the boom, a control device configured to control hydraulic oil flowable into the boom cylinder, and an information obtaining device configured to obtain information on the attachment. The control device is configured to increase the pressure of hydraulic oil flowable into the boom cylinder in accordance with the information on the attachment before a boom raising operation is performed.

DETAILED DESCRIPTION

The large flow area of the conduit, however, prevents the boom from being easily raised when lifting the excavated soil. This is because hydraulic oil that should flow into the boom cylinder flows into the arm cylinder. The same is the case with excavating soil by closing the bucket or excavating soil by simultaneously closing the bucket and closing the arm.

According to an aspect of the present invention, a shovel with a smoother boom raising motion during excavation is provided.

Figure 1:
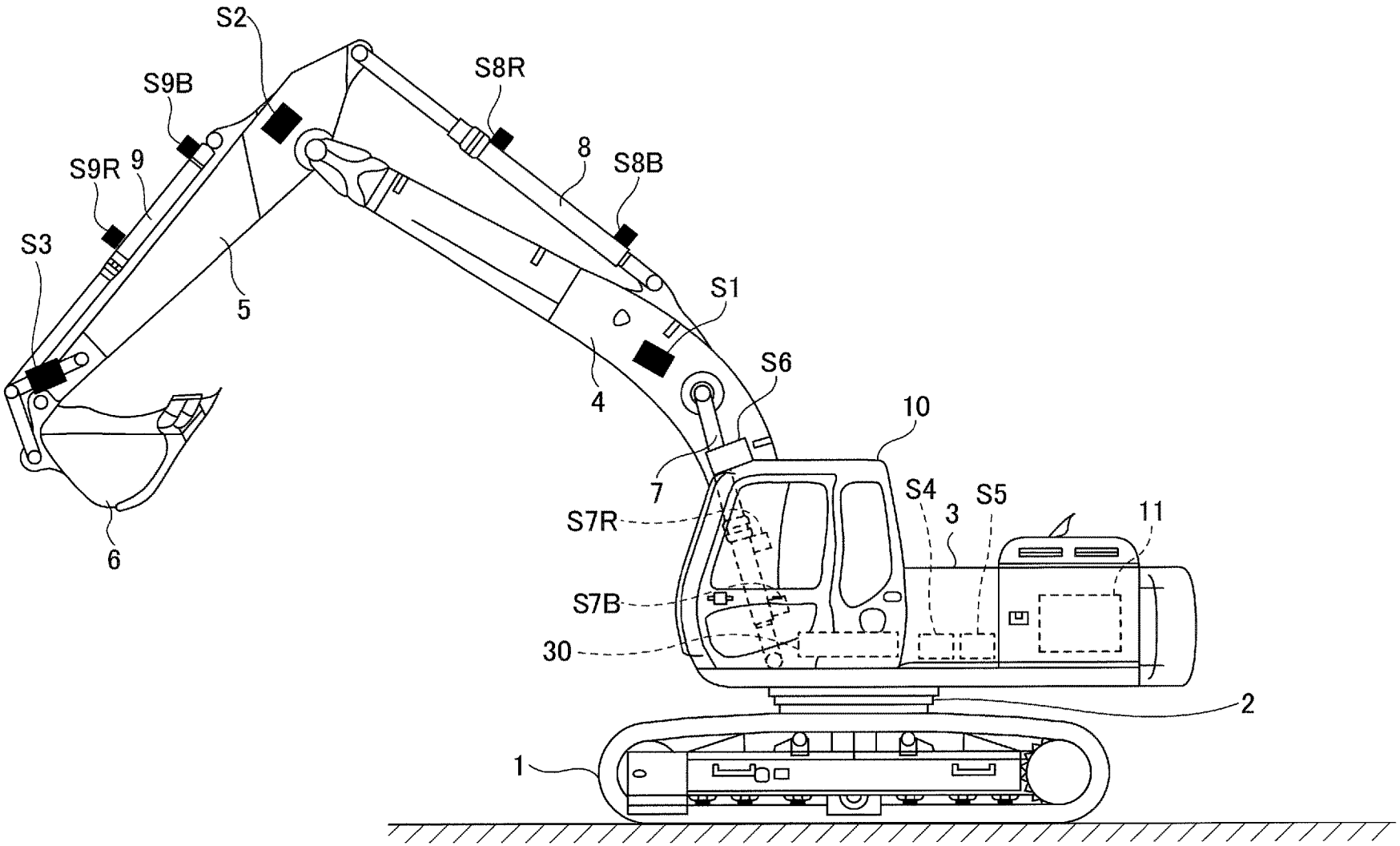
FIG. 1 is a side view of a shovel according to an embodiment of the present invention.

FIG. 1 is a side view of a shovel (excavator) according to an embodiment of the present invention. According to the shovel, an upper turning body 3 is turnably mounted on a lower traveling body 1 through a turning mechanism 2. A boom 4 is attached to the upper turning body 3. An arm 5 is attached to the end of the boom 4. A bucket 6 serving as an end attachment is attached to the end of the arm 5.

The boom 4, the arm 5, and the bucket 6 constitute an excavation attachment that is an example of an attachment, and are hydraulically driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6.

The boom angle sensor S1 detects the rotation angle of the boom 4. According to this embodiment, the boom angle sensor S1 is an acceleration sensor that can detect an inclination to a horizontal plane. Therefore, it is possible to detect the rotation angle of the boom 4 relative to the upper turning body 3 (hereinafter referred to as "boom angle $\alpha$"). The boom angle $\alpha$ is zero degrees when the boom 4 is lowest and increases as the boom 4 is raised, for example.

The arm angle sensor S2 detects the rotation angle of the arm 5. According to this embodiment, the arm angle sensor S2 is an acceleration sensor that can detect an inclination to a horizontal plane. Therefore, it is possible to detect the rotation angle of the arm 5 relative to the boom 4 (hereinafter referred to as "arm angle $\beta$"). The arm angle $\beta$ is zero degrees when the arm 5 is most closed and increases as the arm 5 is opened, for example.

The bucket angle sensor S3 detects the rotation angle of the bucket 6. According to this embodiment, the bucket angle sensor S3 is an acceleration sensor that can detect an inclination to a horizontal plane. Therefore, it is possible to detect the rotation angle of the bucket 6 relative to the arm 5 (hereinafter referred to as "bucket angle $\gamma$"). The bucket angle $\gamma$ is zero degrees when the bucket 6 is most closed and increases as the bucket 6 is opened, for example.

Each of the boom angle sensor S1, the arm angle sensor S2, and the bucket angle sensor S3 may alternatively be a potentiometer using a variable resistor, a stroke sensor that detects the stroke amount of a corresponding hydraulic cylinder, a rotary encoder that detects a rotation angle about a link pin, a gyro sensor, a combination of an acceleration sensor and a gyro sensor, or the like. The boom angle sensor S1, the arm angle sensor S2, and the bucket angle sensor S3 constitute a posture sensor that detects information on the posture of the excavation attachment.

A boom rod pressure sensor S7R and a boom bottom pressure sensor S7B are attached to the boom cylinder 7. An arm rod pressure sensor S8R and an arm bottom pressure sensor S8B are attached to the arm cylinder 8. A bucket rod pressure sensor S9R and a bucket bottom pressure sensor S9B are attached to the bucket cylinder 9. The boom rod pressure sensor S7R, the boom bottom pressure sensor S7B, the arm rod pressure sensor S8R, the arm bottom pressure sensor S8B, the bucket rod pressure sensor S9R, and the bucket bottom pressure sensor S9B are specific examples of cylinder pressure sensors.

The boom rod pressure sensor S7R detects the pressure of the rod-side oil chamber of the boom cylinder 7 (hereinafter, "boom rod pressure"), and the boom bottom pressure sensor S7B detects the pressure of the bottom-side oil chamber of the boom cylinder 7 (hereinafter, "boom bottom pressure"). The arm rod pressure sensor S8R detects the pressure of the rod-side oil chamber of the arm cylinder 8 (hereinafter, "arm rod pressure"), and the arm bottom pressure sensor S8B detects the pressure of the bottom-side oil chamber of the arm cylinder 8 (hereinafter, "arm bottom pressure"). The bucket rod pressure sensor S9R detects the pressure of the rod-side oil chamber of the bucket cylinder 9 (hereinafter, "bucket rod pressure"), and the bucket bottom pressure sensor S9B detects the pressure of the bottom-side oil chamber of the bucket cylinder 9 (hereinafter, "bucket bottom pressure").

A cabin 10 that is a cab is provided and power sources such as an engine 11 are mounted on the upper turning body 3. A body tilt sensor S4, a turning angular velocity sensor S5, and a camera S6 are attached to the upper turning body 3.

The body tilt sensor S4 detects the tilt of the upper turning body 3 relative to a horizontal plane. According to this embodiment, the body tilt sensor S4 is an acceleration sensor that detects the tilt angle of the upper turning body 3 about its longitudinal axis and lateral axis. The longitudinal axis and lateral axis of the upper turning body 3 are orthogonal to each other and pass through the center point of the shovel that is a point on the turning axis of the shovel, for example.

The turning angular velocity sensor S5 detects the turning angular velocity of the upper turning body 3. The turning angular velocity sensor S5 is a gyro sensor according to this embodiment, but may alternatively be a resolver, a rotary encoder, or the like.

The camera S6 is a device that obtains an image of an area surrounding the shovel. According to this embodiment, the camera S6 includes a front camera attached to the upper turning body 3. The front camera is a stereo camera that captures an image of an area in front of the shovel. The front camera is attached to the roof of the cabin 10, namely, the exterior of the cabin 10, but may alternatively be attached to the ceiling of the cabin 10, namely, the interior of the cabin 10. The front camera can capture an image of the inside of the bucket 6. The front camera may alternatively be a monocular camera.

A controller 30 is installed in the cabin 10. The controller 30 serves as a main control part that controls the driving of the shovel. According to this embodiment, the controller 30 is composed of a computer including a CPU, a RAM, a ROM, etc. Various functions of the controller 30 are implemented by the CPU executing programs stored in the ROM, for example.

Figure 2:
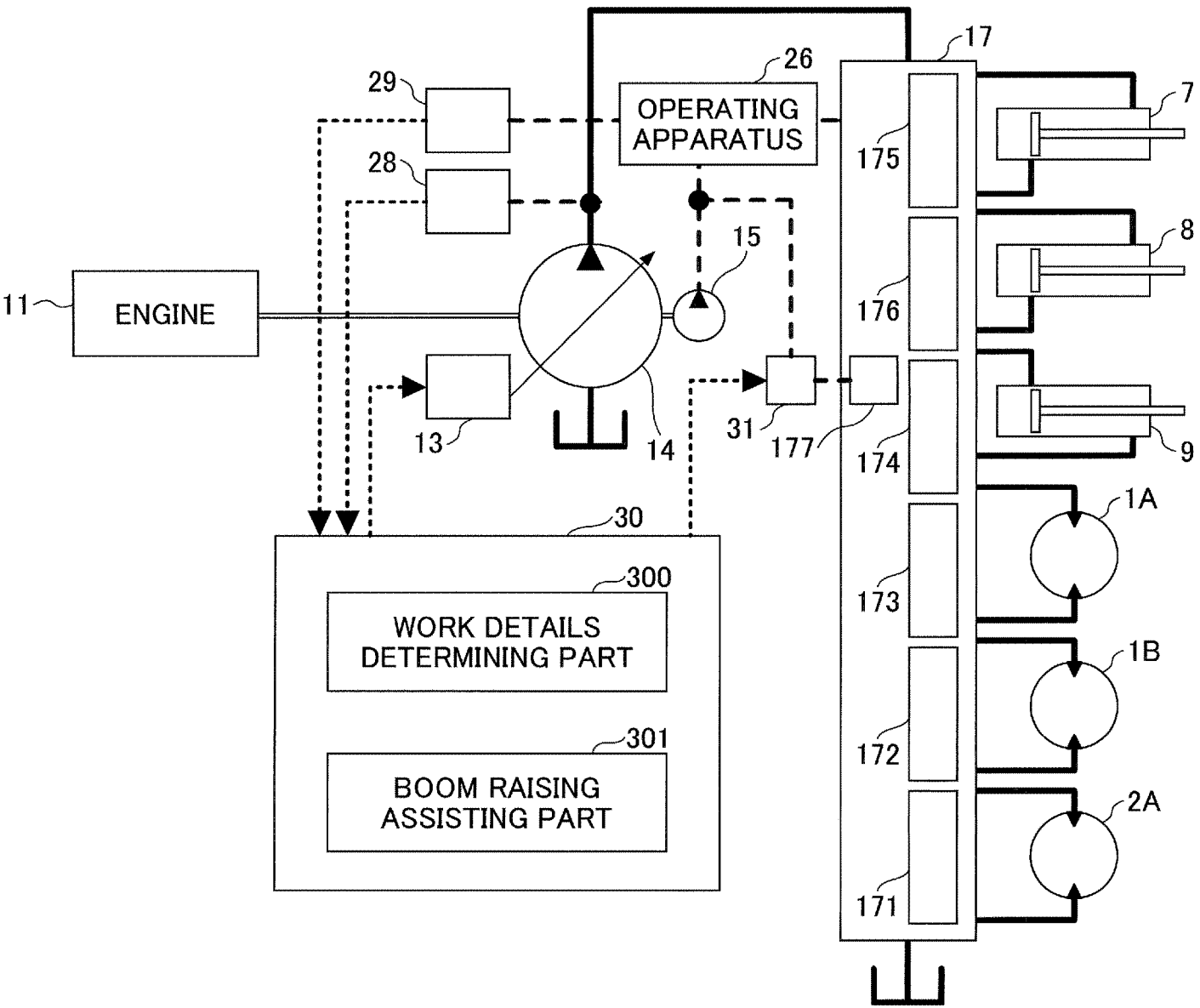
FIG. 2 is a block diagram illustrating an example configuration of the drive system of the shovel of FIG. 1.

FIG. 2 is a block diagram illustrating an example configuration of the drive system of the shovel of FIG. 1, indicating a mechanical power system, a high pressure hydraulic line, a pilot line, and an electric control system by a double line, a thick solid line, a dashed line, and a dotted line, respectively.

The drive system of the shovel mainly includes the engine 11, a regulator 13, a main pump 14, a pilot pump 15, a control valve 17, an operating apparatus 26, a discharge pressure sensor 28, an operating pressure sensor 29, the controller 30, and a proportional valve 31.

The engine 11 is a drive source of the shovel. According to this embodiment, the engine 11 is, for example, a diesel engine that so operates as to maintain a predetermined rotational speed. The output shaft of the engine 11 is coupled to the input shafts of the main pump 14 and the pilot pump 15.

The main pump 14 supplies hydraulic oil to the control valve 17 via a high pressure hydraulic line. According to this embodiment, the main pump 14 is a swash plate variable displacement hydraulic pump.

The regulator 13 controls the discharge quantity of the main pump 14. According to this embodiment, the regulator 13 controls the discharge quantity of the main pump 14 by adjusting the tilt angle of the swash plate of the main pump 14 in response to a control command from the controller 30.

The pilot pump 15 supplies hydraulic oil to various hydraulic control apparatuses including the operating apparatus 26 and the proportional valve 31 via a pilot line. According to this embodiment, the pilot pump 15 is a fixed displacement hydraulic pump.

The control valve 17 is a hydraulic controller that controls the hydraulic system of the shovel. The control valve 17 includes control valves 171 through 177. The control valve 17 can selectively supply hydraulic oil discharged by the main pump 14 to one or more hydraulic actuators through the control valves 171 through 176. The control valves 171 through 176 control the flow rate of hydraulic oil flowing from the main pump 14 to hydraulic actuators and the flow rate of hydraulic oil flowing from hydraulic actuators to a hydraulic oil tank. The hydraulic actuators include the boom cylinder 7, the arm cylinder 8, the bucket cylinder 9, a left side traveling hydraulic motor 1A, a right side traveling hydraulic motor 1B, and a turning hydraulic motor 2A. The control valve 177 controls the flow rate of hydraulic oil passing through each of the arm cylinder 8 and the bucket cylinder 9.

The operating apparatus 26 is an apparatus that an operator uses to operate hydraulic actuators. According to this embodiment, the operating apparatus 26 supplies hydraulic oil discharged by the pilot pump 15 to the pilot ports of control valves corresponding to hydraulic actuators through a pilot line. The pressure of hydraulic oil supplied to each pilot port (pilot pressure) is a pressure commensurate with the direction of operation and the amount of operation of a lever or pedal (not depicted) of the operating apparatus 26 for a corresponding hydraulic actuator.

The discharge pressure sensor 28 detects the discharge pressure of the main pump 14. According to this embodiment, the discharge pressure sensor 28 outputs the detected value to the controller 30.

The operating pressure sensor 29 detects the details of the operator's operation using the operating apparatus 26. According to this embodiment, the operating pressure sensor 29 detects the direction of operation and the amount of operation of a lever or pedal of the operating apparatus 26 for a corresponding hydraulic actuator in the form of pressure, and outputs the detected value to the controller 30. The details of the operation of the operating apparatus 26 may be detected using a sensor other than an operating pressure sensor.

The controller 30 reads programs corresponding to a work details determining part 300 and a boom raising assisting part 301 from the ROM, loads them into the RAM, and causes the CPU to execute corresponding processes.

Specifically, the controller 30 executes processes by the work details determining part 300 and the boom raising assisting part 301 based on the outputs of various sensors. The controller 30 suitably outputs control commands corresponding to the processing results of the work details determining part 300 and the boom raising assisting part 301 to the regulator 13, the proportional valve 31, etc.

The work details determining part 300 determines, for example, whether the motion of closing the arm 5 is a motion for high load work such as excavation work or a motion for low load work such as leveling work. According to this embodiment, the work details determining part 300 determines that the motion is for high load work when the detected value of the arm bottom pressure sensor S8B is more than or equal to a predetermined value. In response to determining that the motion is for high load work, the work details determining part 300 outputs a control command to the proportional valve 31. The work details determining part 300 may determine whether the motion is for high load work or low load work based on the output of one or more of other information obtaining devices such as the camera S6, a LIDAR, a millimeter wave radar, etc.

The proportional valve 31 operates in response to a control command output by the controller 30. According to this embodiment, the proportional valve 31 is a solenoid valve that adjusts a control pressure introduced from the pilot pump 15 to a pilot port of the control valve 177 in the control vale 17 in response to an electric current command output by the controller 30. The controller 30, for example, activates the control valve 177 installed in a conduit connecting the rod-side oil chamber of the arm cylinder 8 and the hydraulic oil tank and increases the flow area of the conduit. This configuration enables the controller 30 to reduce pressure loss generated by hydraulic oil flowing from the rod-side oil chamber of the arm cylinder 8 to the hydraulic oil tank when closing the arm 5 for high load work.

The work details determining part 300 may determine whether the motion of closing the bucket 6 is a motion for high load work or a motion for low load work. In this case, the work details determining part 300 determines that the motion is for high load work when the detected value of the bucket bottom pressure sensor S9B is more than or equal to a predetermined value. In response to determining that the motion is for high load work, the work details determining part 300 outputs a control command to the proportional valve 31. The proportional valve 31 activates the control valve 177 installed in a conduit connecting the rod-side oil chamber of the bucket cylinder 9 and the hydraulic oil tank and increases the flow area of the conduit. This configuration enables the controller 30 to reduce pressure loss generated by hydraulic oil flowing from the rod-side oil chamber of the bucket cylinder 9 to the hydraulic oil tank when closing the bucket 6 for high load work.

The work details determining part 300 may determine whether excavation has been started or whether excavation is in progress. In this case, the work details determining part 300 may perform the determination based on information on the attachment obtained by an information obtaining device, for example. The information on the attachment includes at least one of the boom angle $\alpha$, the arm angle $\beta$, the bucket angle $\gamma$, the boom rod pressure, the boom bottom pressure, the arm rod pressure, the arm bottom pressure, the bucket rod pressure, the bucket bottom pressure, an image captured by the camera S6, etc. The information obtaining device includes at least one of the boom angle sensor S1, the arm angle sensor S2, the bucket angle sensor S3, the body tilt sensor S4, the turning angular velocity sensor S5, the camera S6, the boom rod pressure sensor S7R, the boom bottom pressure sensor S7B, the arm rod pressure sensor S8R, the arm bottom pressure sensor S8B, the bucket rod pressure sensor S9R, the bucket bottom pressure sensor S9B, the discharge pressure sensor 28, the operating pressure sensor 29, a LIDAR, a millimeter wave radar, an inertial measurement unit, etc.

Figure 3:
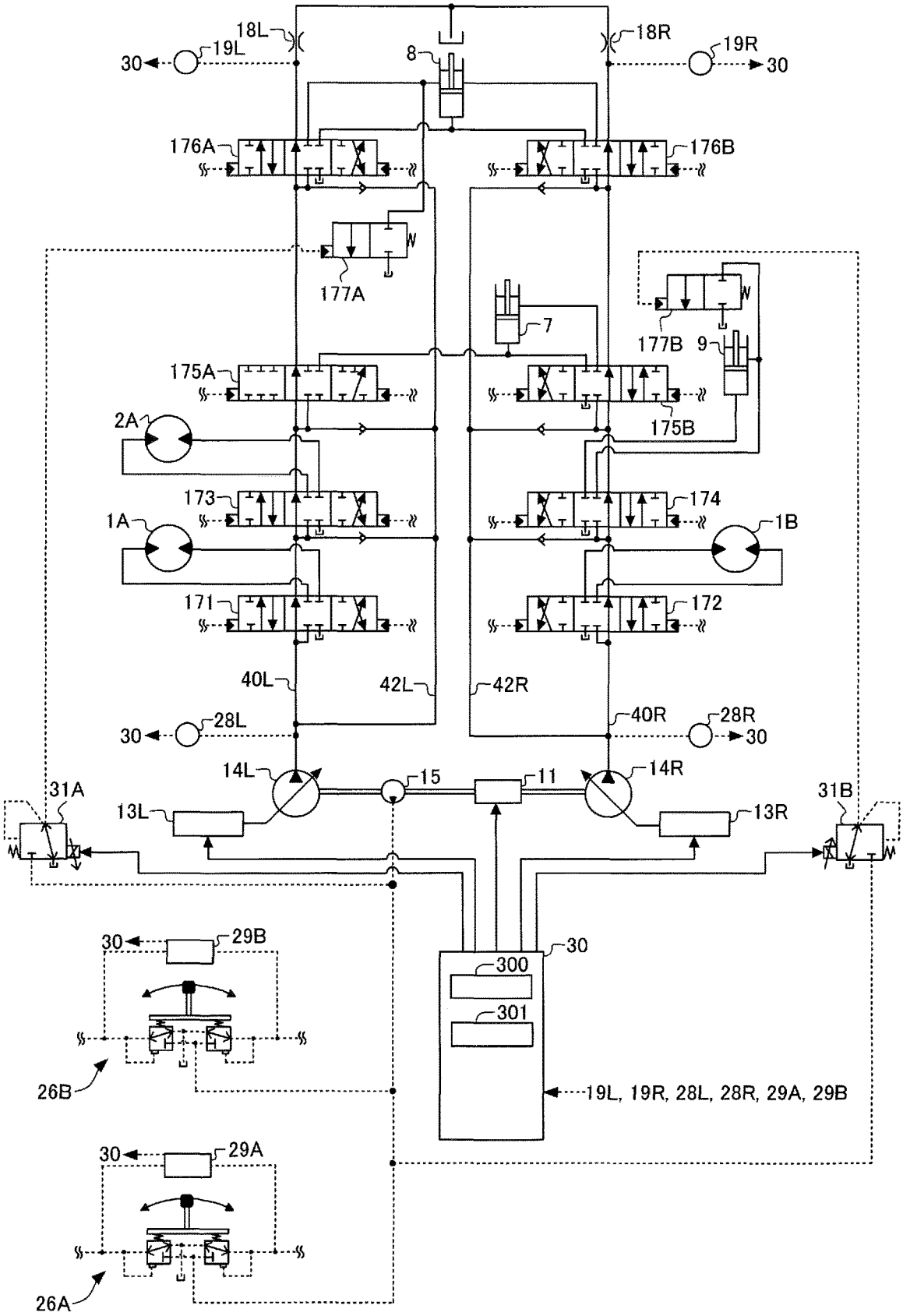
FIG. 3 is a schematic diagram illustrating an example configuration of a hydraulic system installed in the shovel of FIG. 1.

Next, an example configuration of a hydraulic system installed in the shovel is described with reference to FIG. 3. FIG. 3 is a schematic diagram illustrating an example configuration of a hydraulic system installed in the shovel of FIG. 1. Like FIG. 2, FIG. 3 indicates a mechanical power system, a high pressure hydraulic line, a pilot line, and an electric control system by a double line, a thick solid line, a dashed line, and a dotted line, respectively.

Referring to FIG. 3, the hydraulic system circulates hydraulic oil from main pumps 14L and 14R driven by the engine 11 to the hydraulic oil tank via center bypass conduits 40L and 40R and parallel conduits 42L and 42R. The main pumps 14L and 14R correspond to the main pump 14 of FIG. 2.

The center bypass conduit 40L is a high pressure hydraulic line that passes through the control valves 171 and 173 and control valves 175A and 176A placed in the control valve 17. The center bypass conduit 40R is a high pressure hydraulic line that passes through the control valves 172 and 174 and control valves 175B and 176B placed in the control valve 17.

The control valve 171 is a spool valve that switches the flow of hydraulic oil in order to supply hydraulic oil discharged by the main pump 14L to the left side traveling hydraulic motor 1A and to discharge hydraulic oil discharged by the left side traveling hydraulic motor 1A to the hydraulic oil tank.

The control valve 172 is a spool valve that switches the flow of hydraulic oil in order to supply hydraulic oil discharged by the main pump 14R to the right side traveling hydraulic motor 1B and to discharge hydraulic oil discharged by the right side traveling hydraulic motor 1B to the hydraulic oil tank.

The control valve 173 is a spool valve that switches the flow of hydraulic oil in order to supply hydraulic oil discharged by the main pump 14L to the turning hydraulic motor 2A and to discharge hydraulic oil discharged by the turning hydraulic motor 2A to the hydraulic oil tank.

The control valve 174 is a spool valve for supplying hydraulic oil discharged by the main pump 14R to the bucket cylinder 9 and to discharge hydraulic oil in the bucket cylinder 9 to the hydraulic oil tank.

The control valves 175A and 175B correspond to the control valve 175 of FIG. 2. The control valves 175A and 175B are spool valves that switch the flow of hydraulic oil in order to supply hydraulic oil discharged by the main pumps 14L and 14R to the boom cylinder 7 and to discharge hydraulic oil in the boom cylinder 7 to the hydraulic oil tank.

The control valves 176A and 176B correspond to the control valve 176 of FIG. 2. The control valves 176A and 176B are spool valves that switch the flow of hydraulic oil in order to supply hydraulic oil discharged by the main pumps 14L and 14R to the arm cylinder 8 and to discharge hydraulic oil in the arm cylinder 8 to the hydraulic oil tank.

Control valves 177A and 177B correspond to the control valve 177 of FIG. 2. The control valve 177A is a spool valve that controls the flow rate of hydraulic oil flowing out of the rod-side oil chamber of the arm cylinder 8 to the hydraulic oil tank. The control valve 177B is a spool valve that controls the flow rate of hydraulic oil flowing out of the rod-side oil chamber of the bucket cylinder 9 to the hydraulic oil tank.

The control valves 177A and 177B have a first valve position of a minimum opening area (an opening degree of 0%) and a second valve position of a maximum opening area (an opening degree of 100%). The control valves 177A and 177B can steplessly move between the first valve position and the second valve position.

The parallel conduit 42L is a high pressure hydraulic line parallel to the center bypass conduit 40L. When the flow of hydraulic oil through the center bypass conduit 40L is restricted or blocked by any of the control valves 171, 173 and 175A, the parallel conduit 42L can supply hydraulic oil to a control valve further downstream. The parallel conduit 42R is a high pressure hydraulic line parallel to the center bypass conduit 40R. When the flow of hydraulic oil through the center bypass conduit 40R is restricted or blocked by any of the control valves 172, 174 and 175B, the parallel conduit 42R can supply hydraulic oil to a control valve further downstream.

Regulators 13L and 13R control the discharge quantity of the main pumps 14L and 14R by adjusting the swash plate tilt angle of the main pumps 14L and 14R in accordance with the discharge pressure of the main pumps 14L and 14R. The regulators 13L and 13R correspond to the regulator 13 of FIG. 2. The regulators 13L and 13R reduce the discharge quantity by adjusting the swash plate tilt angle of the main pumps 14L and 14R in response to an increase in the discharge pressure of the main pumps 14L and 14R, for example. This is for preventing the absorbed power of the main pump 14 expressed by the product of the discharge pressure and the discharge quantity from exceeding the output power of the engine 11.

An arm operating lever 26A, which is an example of the operating apparatus 26, is used to operate the arm 5. The arm operating lever 26A uses hydraulic oil discharged by the pilot pump 15 to introduce a control pressure commensurate with the amount of lever operation to pilot ports of the control valves 176A and 176B. Specifically, when operated in an arm closing direction, the arm operating lever 26A introduces hydraulic oil to the right side pilot port of the control valve 176A and introduces hydraulic oil to the left side pilot port of the control valve 176B. Furthermore, when operated in an arm opening direction, the arm operating lever 26A introduces hydraulic oil to the left side pilot port of the control valve 176A and introduces hydraulic oil to the right side pilot port of the control valve 176B.

A bucket operating lever 26B, which is an example of the operating apparatus 26, is used to operate the bucket 6. The bucket operating lever 26B uses hydraulic oil discharged by the pilot pump 15 to introduce a control pressure commensurate with the amount of lever operation to a pilot port of the control valve 174. Specifically, the bucket operating lever 26B introduces hydraulic oil to the right side pilot port of the control valve 174 when operated in a bucket opening direction, and introduces hydraulic oil to the left side pilot port of the control valve 174 when operated in a bucket closing direction.

Discharge pressure sensors 28L and 28R, which are examples of the discharge pressure sensor 28, detect the discharge pressure of the main pumps 14L and 14R, and output the detected value to the controller 30.

Operating pressure sensors 29A and 29B, which are examples of the operating pressure sensor 29, detect the details of the operator's operation on the arm operating lever 26A and the bucket operating lever 26B in the form of pressure, and output the detected value to the controller 30. Examples of the details of operation include the direction of lever operation and the amount of lever operation (the angle of lever operation).

Right and left traveling levers (or pedals), a boom operating lever, and a turning operating lever (none of which is depicted) are operating apparatuses for performing operations for causing the lower traveling body 1 to travel, raising and lowering the boom 4, and turning the upper turning body 3, respectively. Like the arm operating lever 26A and the bucket operating lever 26B, these operating apparatuses each introduce a control pressure commensurate with the amount of lever operation (or the amount of pedal operation) to the right or left pilot port of a control valve for a corresponding hydraulic actuator, using hydraulic oil discharged by the pilot pump 15. The details of the operator's operation on each of these operating apparatuses are detected in the form of pressure by a corresponding operating pressure sensor like the operating pressure sensors 29A and 29B, and the detected value is output to the controller 30.

The controller 30 receives the outputs of the operating pressure sensors 29A and 29B, etc., and outputs a control command to the regulators 13L and 13R to change the discharge quantity of the main pump 14L and 14R on an as-needed basis.

Proportional valves 31A and 31B adjust a control pressure introduced from the pilot pump 15 to the pilot ports of the control valves 177A and 177B, in response to an electric current command output by the controller 30. The proportional valves 31A and 31B correspond to the proportional valve 31 of FIG. 2.

The proportional valve 31A can adjust the control pressure so that the control valve 177A can stop at any position between the first valve position and the second valve position. The proportional valve 31B can adjust the control pressure so that the control valve 177B can stop at any position between the first valve position and the second valve position.

Here, negative control (hereinafter referred to as "NEG control") adopted in the hydraulic system of FIG. 3 is described.

In the center bypass conduits 40L and 40R, negative control throttles 18L and 18R are placed between the most downstream control valves 176A and 176B and the hydraulic oil tank. The flow of hydraulic oil discharged by the main pumps 14L and 14R is restricted by the negative control throttles 18L and 18R. The negative control throttles 18L and 18R generate a control pressure for controlling the regulators 13L and 13R (hereinafter referred to as "NEG control pressure"). NEG control pressure sensors 19L and 19R are sensors for detecting the NEG control pressure, and output the detected value to the controller 30.

The controller 30 controls the discharge quantity of the main pumps 14L and 14R by adjusting the swash plate tilt angle of the main pumps 14L and 14R in accordance with the NEG control pressure. The controller 30 decreases the discharge quantity of the main pumps 14L and 14R as the NEG control pressure increases, and increases the discharge quantity of the main pumps 14L and 14R as the NEG control pressure decreases.

Specifically, as illustrated in FIG. 3, in the standby state where none of the hydraulic actuators in the shovel is in operation, hydraulic oil discharged by the main pumps 14L and 14R passes through the center bypass conduits 40L and 40R to reach the negative control throttles 18L and 18R. The flow of hydraulic oil discharged by the main pumps 14L and 14R increases the NEG control pressure generated upstream of the negative control throttles 18L and 18R. As a result, the controller 30 decreases the discharge quantity of the main pumps 14L and 14R to a minimum allowable discharge quantity to control pressure loss (pumping loss) during passage of the discharged hydraulic oil through the center bypass conduits 40L and 40R.

When any of the hydraulic actuator is operated, hydraulic oil discharged by the main pumps 14L and 14R flows into the operated hydraulic actuator through a control valve corresponding to the operated hydraulic actuator. The flow of hydraulic oil discharged by the main pumps 14L and 14R that reaches the negative control throttles 18L and 18R is reduced in amount or lost, so that the NEG control pressure generated upstream of the negative control throttles 18L and 18R is reduced. As a result, the controller 30 increases the discharge quantity of the main pumps 14L and 14R to circulate sufficient hydraulic oil to the operated hydraulic actuator to ensure driving of the operated hydraulic actuator.

According to the configuration as described above, the hydraulic system of FIG. 3 can reduce unnecessary energy consumption in the main pumps 14L and 14R in the standby state. The unnecessary energy consumption includes pumping loss that hydraulic oil discharged by the main pumps 14L and 14R causes in the center bypass conduits 40L and 40R. Furthermore, in the case of actuating a hydraulic actuator, the hydraulic system of FIG. 3 can ensure that necessary and sufficient hydraulic oil is supplied from the main pumps 14L and 14R to the hydraulic actuator to be actuated.

Next, an excavating and loading motion that is an example motion of the shovel is described with reference to FIG. 4. First, as illustrated in (a) of FIG. 4, the operator lowers the boom 4 with the arm 5 being open and the bucket 6 being open while the bucket 6 is positioned above an excavation position. This is for lowering the bucket 6 such that the end of the bucket 6 is at a desired level above a target of excavation. The boom lowering motion is generally performed simultaneously with the turning motion of the upper turning body 3. Therefore, this complex motion is referred to as boom lowering turning motion.

Figure 4:
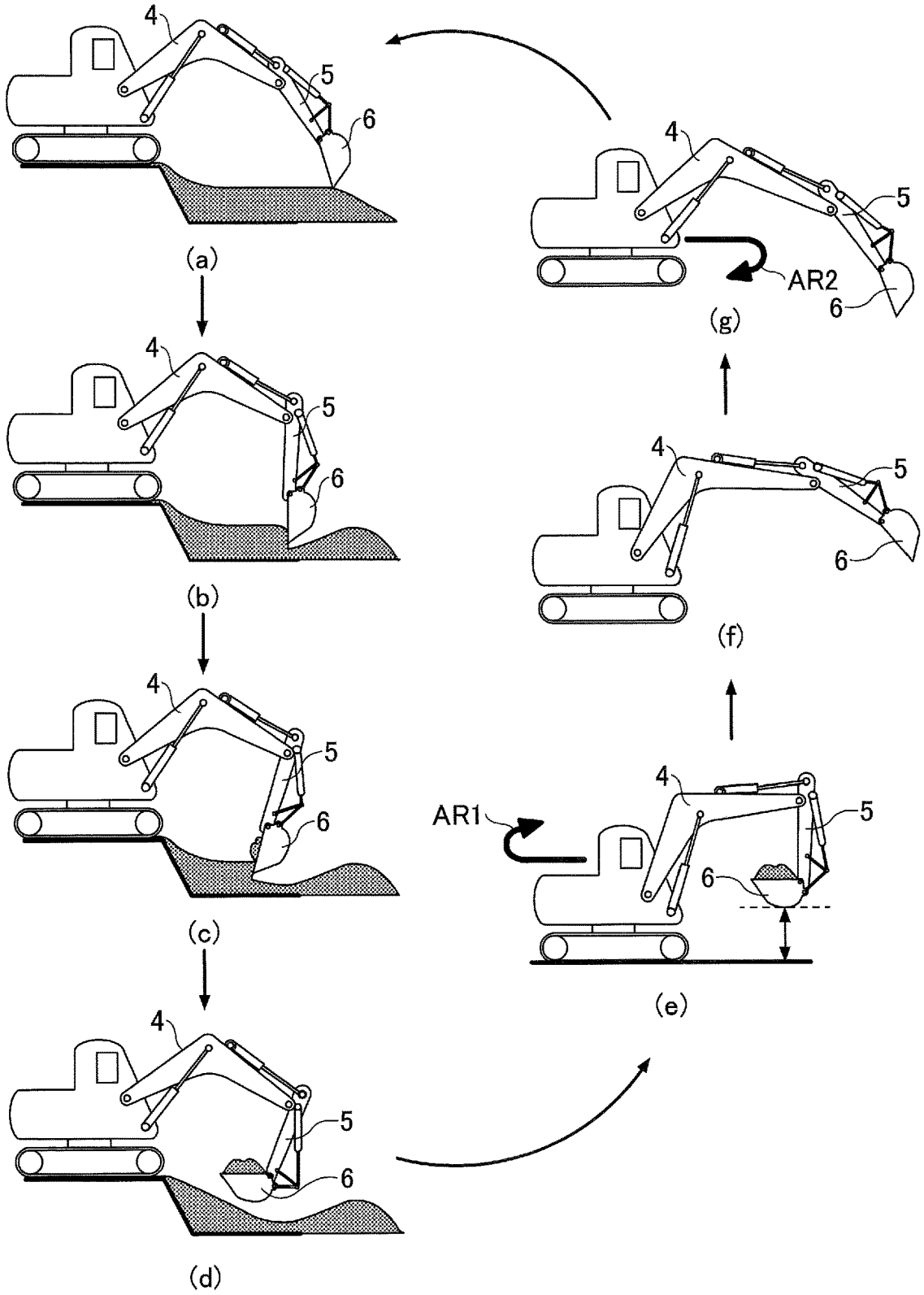
FIG. 4 is a diagram illustrating an excavating and loading motion.

Thereafter, in response to determining that the end of the bucket 6 has reached the desired level, the operator closes the arm 5 until the arm 5 is substantially perpendicular to the ground as illustrated in (b) of FIG. 4. As a result, soil to be excavated is scraped with the bucket 6. Next, as illustrated in (c) and (d) of FIG. 4, the operator further closes the arm 5 and the bucket 6 to accommodate the scooped soil in the bucket 6. The above motion is referred to as excavating motion. Here, in (d) of FIG. 4, the lower end of the bucket 6 during excavation is positioned below a plane in which the shovel is positioned. At this point, the shovel cannot turn because the bucket 6 is surrounded by soil. Therefore, the operator has to perform a boom raising operation to raise the bucket 6 to such a level above the soil around the bucket 6 as to enable the shovel to turn.

Next, as illustrated in (e) of FIG. 4, before the bucket 6 becomes substantially perpendicular to the arm 5, the operator raises the boom 4 while closing the arm 5 and the bucket 6, until the bottom of the bucket 6 is at a desired level above the ground (a position higher than the soil around the bucket 6). This complex motion is referred to as boom raising motion. During the excavating motion before this boom raising motion is performed, hydraulic oil discharged by the main pump 14 flows into the arm cylinder 8 and the bucket cylinder 9. Hydraulic oil flowing out of the arm cylinder 8 is not reduced by the control valve 177A. Likewise, hydraulic oil flowing out of the bucket cylinder 9 is not reduced by the control valve 177B. When the boom raising operation is performed in this state, hydraulic oil to flow into the boom cylinder 7 flows into the arm cylinder 8 and the bucket cylinder 9 whose load (pressure) is relatively low, so that the rising speed of the boom 4 decreases. Therefore, to cause hydraulic oil to flow into the boom cylinder 7, it is desirable to increase a load on (the pressure of) the arm cylinder 8 and the bucket cylinder 9 before the boom raising motion is performed. Thus, according to this embodiment, hydraulic oil is caused to flow into the boom cylinder 7 by increasing resistance to (the pressure of) hydraulic oil in a hydraulic circuit associated with the arm 5 and the bucket 6. As a result, according to this embodiment, even in the complex motion of the arm 5 and the boom 4 or the complex motion of the bucket 6 and the boom 4, the pressure of hydraulic oil flowing into the boom cylinder 7 can be increased, so that the bucket 6 can be smoothly raised to a position above a plane in which the shovel is positioned as illustrated in (e) of FIG. 4.

Next, the operator turns the upper turning body 3 to move the bucket 6 to a soil dumping position by turning as indicated by arrow AR1. This turning motion is generally performed simultaneously with the boom raising operation. Therefore, this complex motion is referred to as boom raising turning motion.

With respect to the complex motion of the arm 5 and turning, turning priority control may be performed. The turning priority control, which is control that gives the highest priority to turning, may be implemented with, for example, a solenoid proportional valve or the like provided in the parallel conduit 42L between the control valve 176A and the control valve 173. According to this turning priority control, the controller 30 reduces the opening of this solenoid proportional valve during the complex motion of the arm 5 and turning, for example. As a result, the flow rate of hydraulic oil flowing to the arm cylinder 8 is reduced, so that the pressure of a turning hydraulic circuit can be ensured. Therefore, the turning motion can be smooth. Likewise, the turning priority control may also be performed during the complex motion of the arm 5, the boom 4, and turning. In this case, the turning priority control may be implemented with, for example, a solenoid proportional valve or the like provided in the parallel conduit 42L between the control valve 176A and the control valve 173. According to this turning priority control, the controller 30 reduces the opening of this solenoid proportional valve during the complex motion of the arm 5, the boom 4, and turning, for example. As a result, the flow rate of hydraulic oil flowing to the arm cylinder 8 is reduced, so that the pressure of a turning hydraulic circuit can be ensured. Therefore, the turning motion can be smooth. With respect to the complex motion of the boom 4 and turning, boom priority control may be performed. The boom priority control, which gives the highest priority to boom raising, may be implemented with, for example, a variable throttle provided between the turning hydraulic motor 2A and the control valve 173. According to this boom priority control, the controller 30 may reduce the opening of this variable throttle during the complex motion of the boom 4 and turning, for example. As a result, boom raising is given preference over turning, so that a pressure necessary for boom raising is ensured.

Next, as illustrated in (f) of FIG. 4, the operator opens the arm 5 and the bucket 6 to dump the soil in the bucket 6. This motion is referred to as dumping motion. According to the dumping motion, only the bucket 6 may be opened to dump the soil.

Next, the operator turns the upper turning body 3 as indicated by arrow AR2 of (g) of FIG. 4 to move the bucket 6 to immediately above the excavation position. At this point, the boom 4 is lowered simultaneously with turning to lower the bucket 6 to a desired level above a target of excavation. This complex motion corresponds to the boom lowering turning motion illustrated in (a) of FIG. 4. The operator lowers the bucket 6 to the desired level as illustrated in (a) of FIG. 4, and again performs the excavating and subsequent motions.

The operator proceeds with excavation and loading, repeatedly performing this sequential excavating and loading motion in which the above-described "boom lowering turning motion," "excavating motion," "boom raising turning motion," and "dumping motion" constitute a cycle.

The work details determining part 300 determines that the work of the shovel is high load work during the excavating motion. Therefore, the work details determining part 300 outputs a control command to the proportional valves 31A and 31B (see FIG. 3) to increase the opening area of the control valves 177A and 177B. This is for reducing pressure loss with respect to hydraulic oil flowing out of each of the arm cylinder 8 and the bucket cylinder 9. In this state, the motion of closing the arm 5 and the bucket 6 becomes fast, while the motion of raising the boom 4 becomes slow. This is because hydraulic oil to flow into the boom cylinder 7 flows into the arm cylinder 8 and the bucket cylinder 9.

Therefore, to make the boom raising motion after the excavating motion smoother, the boom raising assisting part 301 executes a boom raising assisting function before the boom raising motion is performed. The boom raising assisting function is a function to increase the pressure of hydraulic oil that can flow into the boom cylinder 7.

The boom raising assisting part 301 increases the pressure of hydraulic oil that can flow into the boom cylinder 7 in accordance with information on the attachment obtained by the information obtaining device, for example. For example, the boom raising assisting part 301 increases the pressure of hydraulic oil that can flow into the boom cylinder 7 with assisting start timing determined based on the information on the attachment, before the boom raising motion is performed.

The assisting start timing is the timing to start the boom raising assisting function, and is, for example, such timing as to have the bucket 6 filled with soil when the boom raising motion is actually performed. Specifically, the assisting start timing is when the attachment takes a predetermined posture, when the amount of soil in the bucket 6 reaches a predetermined amount, when the arm angle β becomes a predetermined angle or less and the bucket angle γ becomes a predetermined angle or less, or the like.

Figure 5:
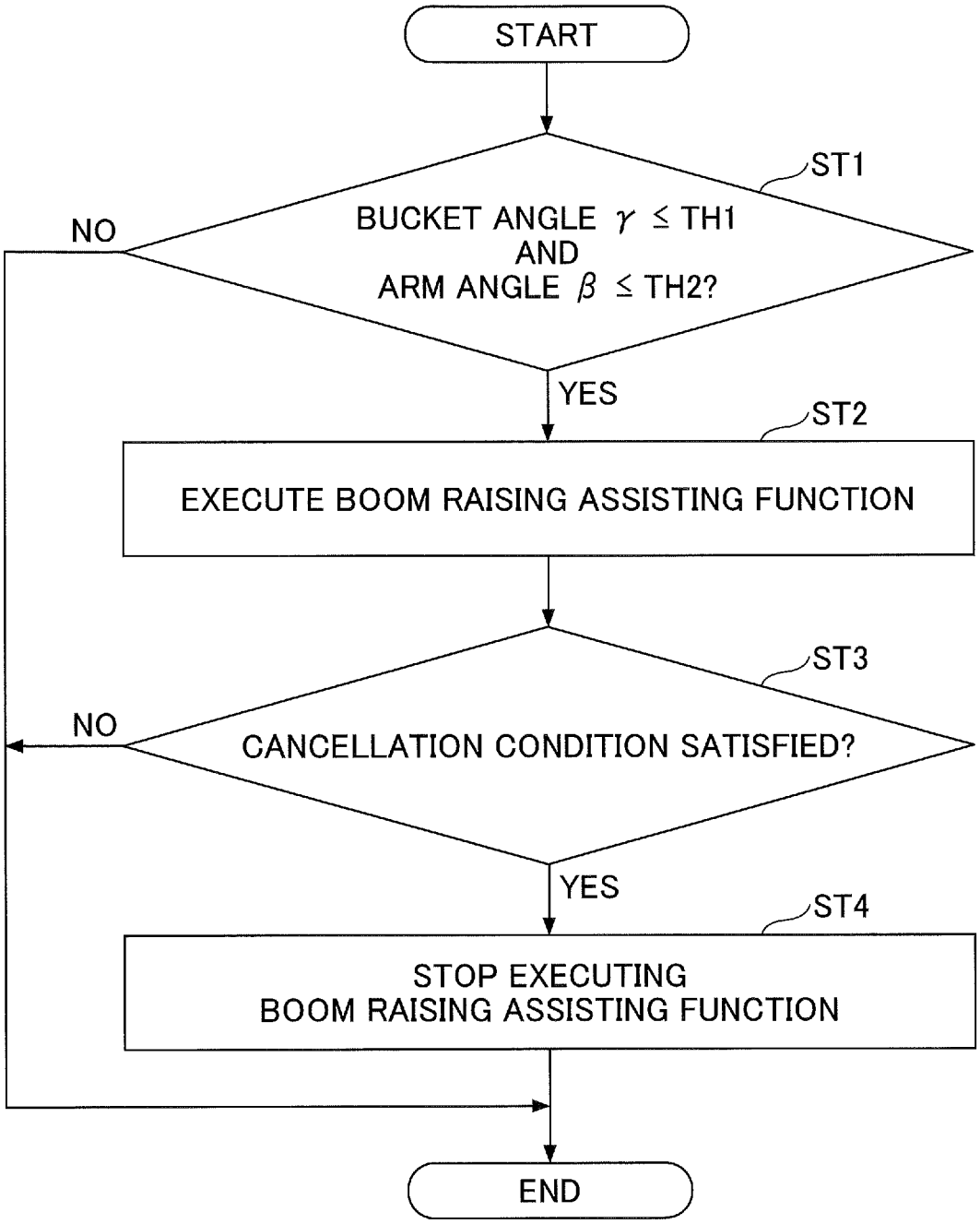
FIG. 5 is a flowchart of an example of a boom raising assisting process.

Here, an example of a boom raising assisting process by the boom raising assisting part 301 is described with reference to FIG. 5. FIG. 5 is a flowchart of an example of the boom raising assisting process. For example, the boom raising assisting part 301 repeatedly executes this process at predetermined control intervals during the operation of the arm operating lever 26A or the bucket operating lever 26B.

First, the boom raising assisting part 301 determines whether the bucket angle γ is less than or equal to a threshold TH1 and the arm angle β is less than or equal to a threshold TH2 (hereinafter, "first state") (step ST1). This is for determining whether the posture of the attachment is in a condition suitable for the boom raising motion, that is, whether it is immediately before performance of the boom raising operation. The state of the attachment in the first state corresponds to, for example, the state of the attachment illustrated in (c) of FIG. 4. The boom raising assisting part 301 may additionally consider the boom angle α to determine whether the posture of the attachment is in a condition suitable for the boom raising operation. Alternatively, the boom raising assisting part 301 may determine whether the posture of the attachment is in a condition suitable for the boom raising motion based solely on the arm angle β or the bucket angle γ.

Alternatively, the boom raising assisting part 301 may estimate a predicted excavation amount based on information on the attachment obtained by the information obtaining device and estimate when the boom raising operation is to be performed, when the excavating motion ends, etc., based on the estimated predicted excavation amount. The predicted excavation amount is, for example, the amount of soil lifted by the bucket 6 when the boom raising operation is performed at this point of time. The timing to perform the boom raising operation is estimated as a remaining time before performance of the boom raising operation, for example. In this case, the boom raising assisting part 301 may determine that it is immediately before performance of the boom raising operation when the remaining time before performance of the boom raising operation is less than or equal to a predetermined value. The same applies to the timing to end the excavating motion.

In response to determining no occurrence of the first state (NO at step ST1), that is, in response to determining that it is not immediately before performance of the boom raising operation, the boom raising assisting part 301 ends the boom raising assisting process of this time without executing the boom raising assisting function.

In response to determining the occurrence of the first state (YES at step ST1), that is, in response to determining that it is immediately before performance of the boom raising operation, the boom raising assisting part 301 executes the boom raising assisting function (step ST2). According to this embodiment, the boom raising assisting part 301 outputs a control command to the proportional valve 31 to increase the pressure of hydraulic oil that can flow into the boom cylinder 7. This is because increasing the pressure of hydraulic oil that can flow into the boom cylinder 7 before performance of the boom raising operation makes it possible to cause hydraulic oil to swiftly flow into the bottom-side oil chamber of the boom cylinder 7 when the boom raising operation is actually performed. In contrast, if the pressure of hydraulic oil that can flow into the boom cylinder 7 is not increased before performance of the boom raising operation, hydraulic oil that is desired to flow into the boom cylinder 7 flows into the arm cylinder 8 or the bucket cylinder 9 when the boom raising operation is actually performed. This is because the pressure of hydraulic oil in each of the arm cylinder 8 and the bucket cylinder 9 is lower than the pressure of hydraulic oil in the boom cylinder 7. As a result, when the boom raising operation is actually performed, the shovel cannot cause hydraulic oil to swiftly flow into the bottom-side oil chamber of the boom cylinder 7 and cannot smoothly raise the boom 4.

Specifically, the boom raising assisting part 301 outputs a control command to the proportional valve 31A (see FIG. 3) to reduce the opening area of the control valve 177A. This is for reducing the flow rate of hydraulic oil flowing from the rod-side oil chamber of the arm cylinder 8 to the hydraulic oil tank. Likewise, the boom raising assisting part 301 outputs a control command to the proportional valve 31B (see FIG. 3) to reduce the opening area of the control valve 177B. This is for reducing the flow rate of hydraulic oil flowing from the rod-side oil chamber of the bucket cylinder 9 to the hydraulic oil tank. As a result, the pressure of hydraulic oil discharged by the main pumps 14L and 14R, namely, the pressure of hydraulic oil that can flow into the boom cylinder 7, increases. Consequently, the shovel can cause hydraulic oil to swiftly flow into the bottom-side oil chamber of the boom cylinder 7 when the boom raising operation is actually performed.

According to this embodiment, the boom raising assisting part 301 determines the opening area of the control valves 177A and 177B at predetermined control intervals in accordance with information on the attachment (e.g., the arm angle β, the bucket angle γ, etc.). The boom raising assisting part 301, however, may reduce the opening area of the control valves 177A and 177B in accordance with a predetermined pattern.

The boom raising assisting part 301 may also increase the engine rotational speed to increase power that the main pumps 14L and 14R can absorb before performance of the boom raising operation. This is because the pressure of hydraulic oil that can flow into the boom cylinder 7 can be increased by increasing the discharge quantity of the main pumps 14L and 14R after increasing power that the main pumps 14L and 14R can absorb.

Thereafter, the boom raising assisting part 301 determines whether a cancellation condition is satisfied (step ST3). The cancellation condition means a condition for stopping executing the boom raising assisting function. Examples of cancellation conditions include the absence of performance of the boom raising operation even after a predetermined period of time has passed since determining the occurrence of the first state, the completion of the boom raising operation, etc.

In response to determining that the cancellation condition is not satisfied (NO at step ST3), the boom raising assisting part 301 ends the boom raising assisting process of this time without stopping executing the boom raising assisting function.

In response to determining that the cancellation condition is satisfied (YES at step ST3), the boom raising assisting part 301 stops executing the boom raising assisting function (step ST4). According to this embodiment, the boom raising assisting part 301 outputs a control command to the proportional valve 31 to stop increasing the pressure of hydraulic oil that can flow into the boom cylinder 7.

Specifically, the boom raising assisting part 301 outputs a control command to the proportional valve 31A (see FIG. 3) to stop reducing the opening area of the control valve 177A. This is for canceling a restriction on the flow rate of hydraulic oil flowing from the rod-side oil chamber of the arm cylinder 8 to the hydraulic oil tank. Likewise, the boom raising assisting part 301 outputs a control command to the proportional valve 31B (see FIG. 3) to stop reducing the opening area of the control valve 177B. This is for canceling a restriction on the flow rate of hydraulic oil flowing from the rod-side oil chamber of the bucket cylinder 9 to the hydraulic oil tank. As a result, increasing the pressure of hydraulic oil discharged by the main pumps 14L and 14R, namely, the pressure of hydraulic oil that can flow into the boom cylinder 7, is stopped. Furthermore, the shovel can restore the operating speed of the arm 5 and the bucket 6 before the execution of the boom raising assisting function.

Figure 6:
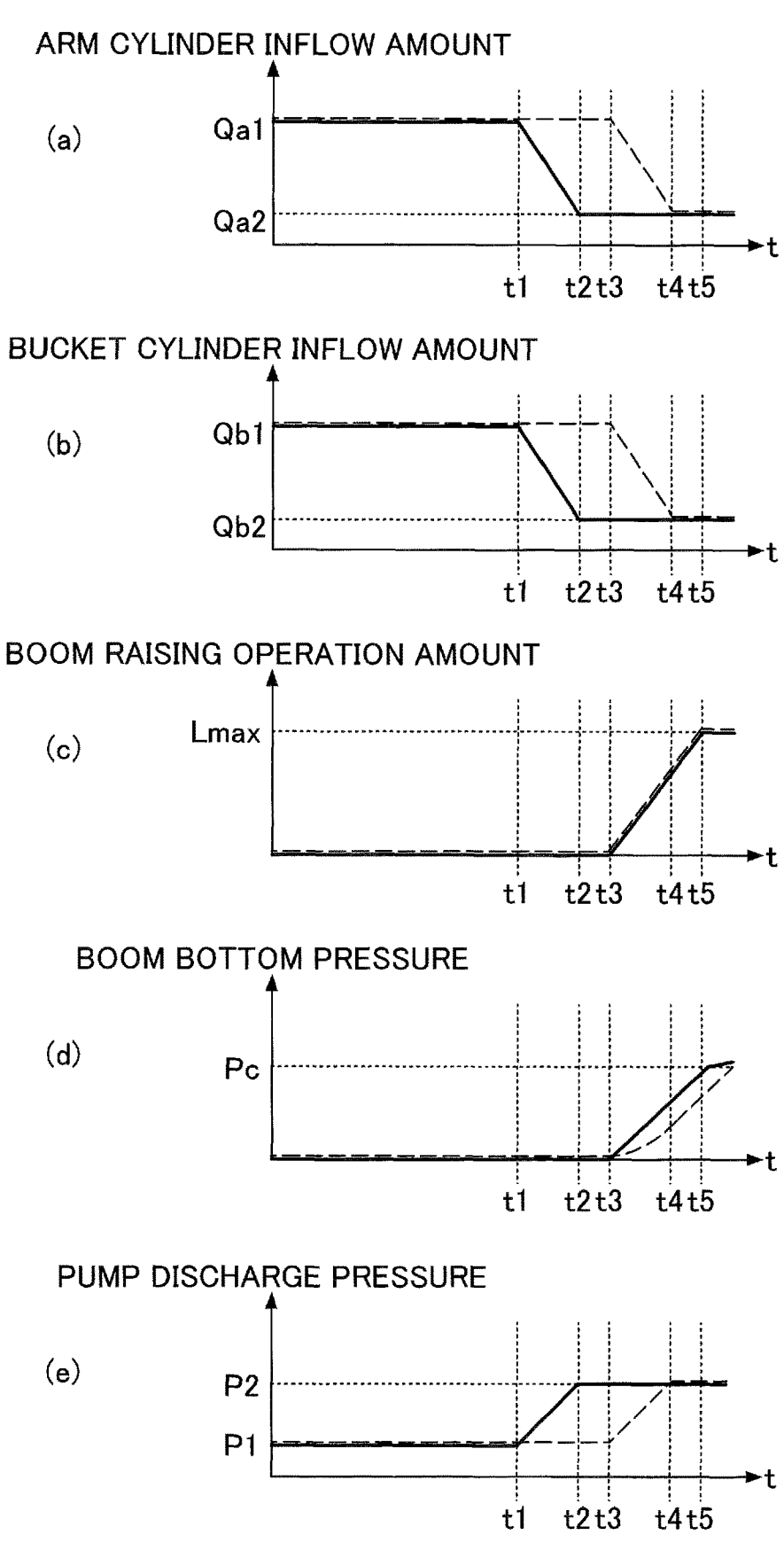
FIG. 6 is a chart illustrating a temporal transition of various physical quantities.

Next, a temporal transition of various physical quantities during execution of the boom raising assisting process is described with reference to FIG. 6. FIG. 6 is a chart illustrating a temporal transition of various physical quantities. Specifically, FIG. 6, at (a), illustrates a temporal transition of the amount of hydraulic oil flowing into the arm cylinder 8 (hereinafter referred to as "arm cylinder inflow amount"). FIG. 6, at (b), illustrates a temporal transition of the amount of hydraulic oil flowing into the bucket cylinder 9 (hereinafter referred to as "bucket cylinder inflow amount"). FIG. 6, at (c), illustrates a temporal transition of the amount of lever operation of the boom operating lever in a raising direction (hereinafter referred to as "boom raising operation amount"). FIG. 6, at (d), illustrates a temporal transition of the boom bottom pressure. FIG. 6, at (e), illustrates a temporal transition of the pump discharge pressure. The horizontal axis (time axis) is common to (a) through (e) of FIG. 6. Furthermore, the solid line in FIG. 6 represents a transition during execution of the boom raising assisting process, and the dashed line in FIG. 6 represents a transition in the case of not executing the boom raising assisting process.

When the boom raising assisting process is in execution, in response to determining, at time t1, the occurrence of the first state, the boom raising assisting part 301 outputs a control command to the proportional valves 31A and 31B (see FIG. 3) to reduce the opening area of the control valves 177A and 177B. As a result, the arm cylinder inflow amount gradually decreases from a flow rate Qa1 to be a flow rate Qa2 at time t2 as indicated by the solid line of (a) of FIG. 6. Likewise, the bucket cylinder inflow amount gradually decreases from a flow rate Qb1 to be a flow rate Qb2 at time t2 as indicated by the solid line of (b) of FIG. 6. The pump discharge pressure gradually increases from a pressure P1 to be a pressure P2 at time t2 as indicated by the solid line of (e) of FIG. 6. This means that the pressure of hydraulic oil that can flow into the boom cylinder 7 has increased to the pressure P2 at time t2.

Thereafter, when the boom raising operation starts at time t3 as indicated by the solid line of (c) of FIG. 6, the boom bottom pressure swiftly increases as indicated by the solid line of (d) of FIG. 6, and the boom 4 smoothly rises. According to this embodiment, the boom raising operation amount reaches a maximum value Lmax at time t5 as indicated by the solid line of (c) of FIG. 6. The boom bottom pressure reaches a pressure Pc at time t5 as indicated by the solid line of (d) of FIG. 6. The pressure Pc is the boom bottom pressure when the bucket 6 is completely detached from the ground.

In contrast, in the case of not executing the boom raising assisting process, the arm cylinder inflow amount remains at the flow rate Qa1 until time t3 when the boom raising operation starts as indicated by the dashed line of (a) of FIG. 6. Likewise, the bucket cylinder inflow amount remains at the flow rate Qb1 until time t3 when the boom raising operation starts as indicated by the dashed line of (b) of FIG. 6. The pump discharge pressure remains at the pressure P1 until time t3 when the boom raising operation starts as indicated by the dashed line of (e) of FIG. 6. This means that the pressure of hydraulic oil that can flow into the boom cylinder 7 is still short of a pressure sufficient to raise the boom 4 at time t3.

Thereafter, when the boom raising operation starts at time t3 as indicated by the dashed line of (c) of FIG. 6, the boom bottom pressure increases, but not as swiftly as in the case where the boom raising assisting process is executed, as indicated by the dashed line of (d) of FIG. 6. Therefore, the boom 4 does not rise swiftly.

When the opening area of the control valve 177A (see FIG. 3) is reduced at time t3, the arm cylinder inflow amount gradually decreases from the flow rate Qa1 to be the flow rate Qa2 at time t4 as indicated by the dashed line of (a) of FIG. 6. Likewise, the bucket cylinder inflow amount gradually decreases from the flow rate Qb1 to be the flow rate Qb2 at time t4 as indicated by the dashed line of (b) of FIG. 6. In this case, the pump discharge pressure gradually increases from the pressure P1 to be the pressure P2 at time t4 as indicated by the dashed line of (e) of FIG. 6. As indicated by the dashed line of (d) of FIG. 6, after time t4 when the pump discharge pressure becomes the pressure P2, the boom bottom pressure increases at the same increase rate as in the case where the boom raising assisting process is executed.

As described above, by executing the boom raising assisting function before the boom raising operation is performed, the boom raising assisting part 301 can raise the boom 4 more smoothly than in the case of not executing the boom raising assisting function when the boom raising operation is actually performed.

Figure 7:
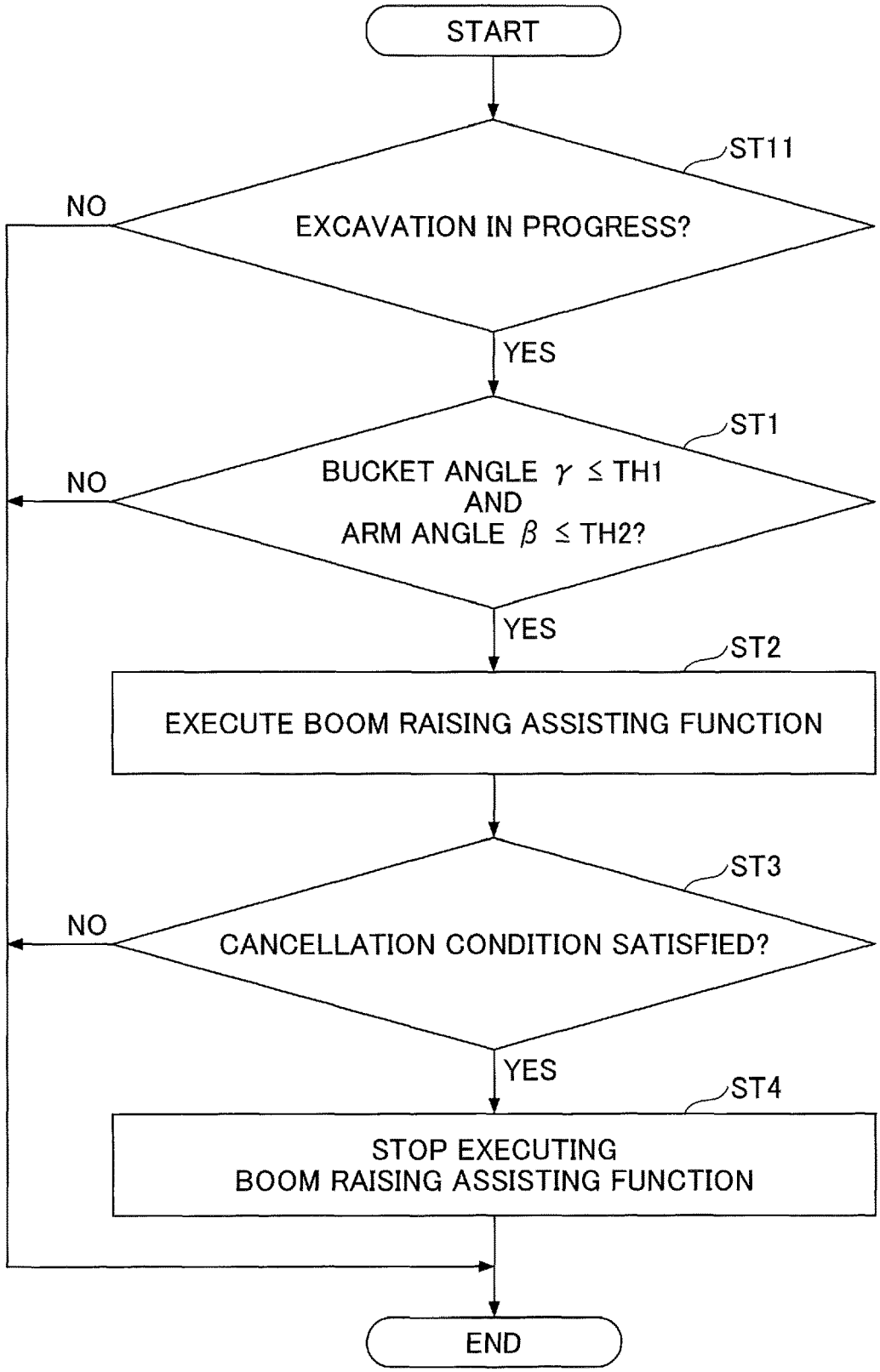
FIG. 7 is a flowchart of another example of the boom raising assisting process.

Next, another example of the boom raising assisting process by the boom raising assisting part 301 is described with reference to FIG. 7. FIG. 7 is a flowchart of another example of the boom raising assisting process. The flowchart of FIG. 7 is different from the flowchart of FIG. 5 in including step ST11. Therefore, a description of a common portion is omitted, and differences are described in detail.

According to the boom raising assisting process illustrated in FIG. 7, the boom raising assisting part 301 first determines whether excavation is in progress (step ST11). The boom raising assisting part 301, for example, uses the result of a determination as to whether excavation is in progress by the work details determining part 300. Alternatively, the boom raising assisting part 301 may determine whether excavation is in progress based on the arm bottom pressure, may determine whether excavation is in progress based on the bucket bottom pressure and the arm bottom pressure, or may determine whether excavation is in progress based on an image captured by the camera S6 (using an image processing technique).

In response to determining that excavation is not in progress (NO at step ST11), the boom raising assisting part 301 ends the boom raising assisting process of this time without determining whether the first state has occurred. In response to determining that excavation is in progress (YES at step ST11), the boom raising assisting part 301 executes the process at and after step ST1. This is for preventing the motion of the arm 5 and the bucket 6 from being slowed down by the execution of the boom raising assisting function during low load work such as subgrade digging work, leveling work, or the like.

This configuration enables the boom raising assisting part 301 to prevent the motion of the arm 5 and the bucket 6 from being slowed down by the boom raising assisting function being executed because of the occurrence of the first state although low load work is being performed.

Figure 8:
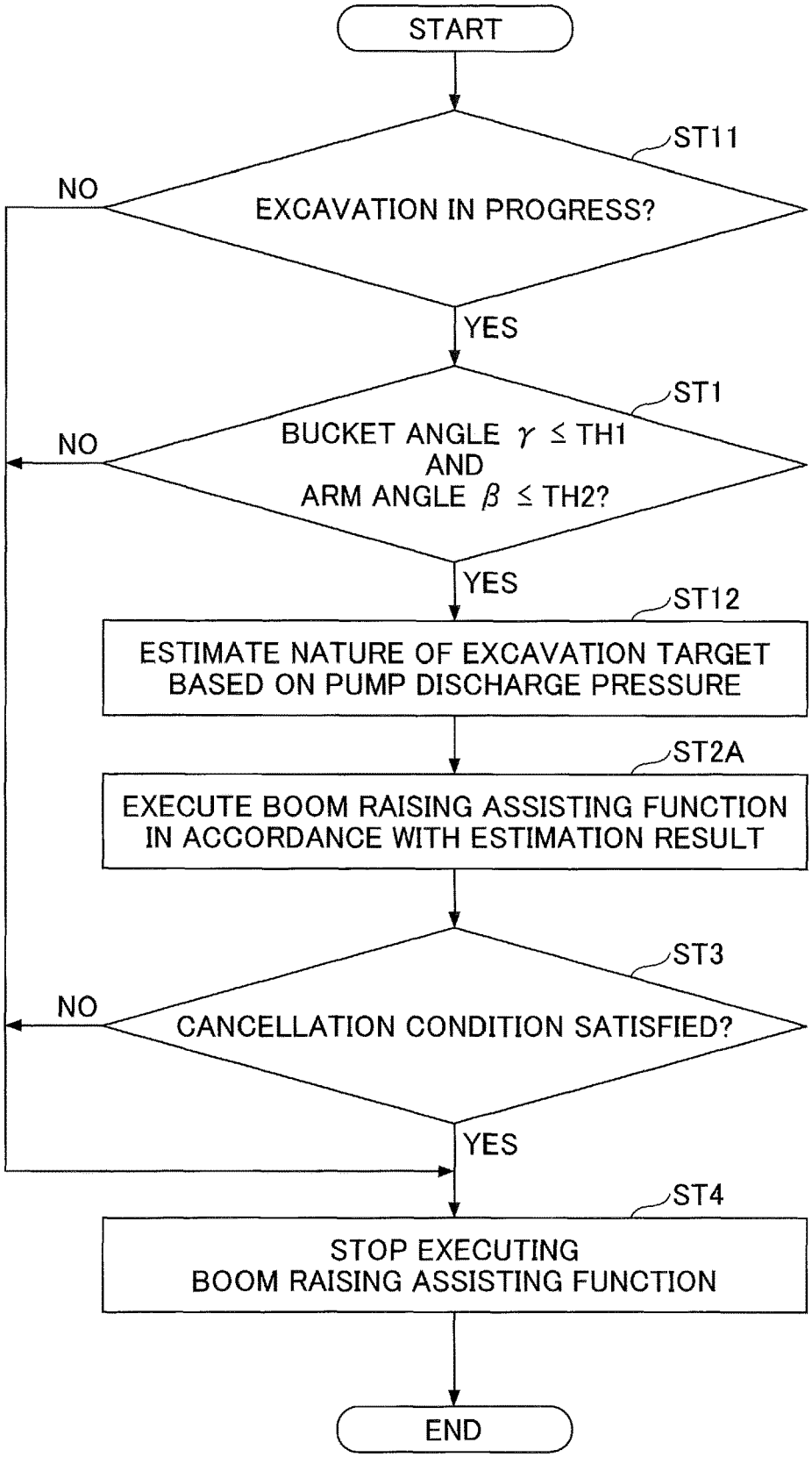
FIG. 8 is a flowchart of yet another example of the boom raising assisting process.

Next, yet another example of the boom raising assisting process by the boom raising assisting part 301 is described with reference to FIG. 8. FIG. 8 is a flowchart of yet another example of the boom raising assisting process. The flowchart of FIG. 8 is different from the flowchart of FIG. 7 in including step ST12 and including step ST2A in place of step ST2. Therefore, a description of a common portion is omitted, and differences are described in detail.

In response to determining the occurrence of the first state (YES at step ST1), the boom raising assisting part 301 estimates the nature of an excavation target based on the pump discharge pressure (step ST12). For example, the boom raising assisting part 301 estimates soil to be excavated to be harder as the pump discharge pressure is higher and estimates soil to be excavated to be softer as the pump discharge pressure is lower. In this case, the boom raising assisting part 301 may estimate the hardness of soil to be excavated in multiple levels or may estimate the hardness of soil to be excavated in a continuously variable manner by calculating the hardness of the excavation target.

Then, the boom raising assisting part 301 executes the boom raising assisting function in accordance with the estimation result (step ST2A). For example, the boom raising assisting part 301 refers to a table prestored in the ROM or the like and derives the opening area of the control valve 177 corresponding to a combination of the estimated level, the arm angle β, and the bucket angle γ. Alternatively, the boom raising assisting part 301 may calculate the opening area from the hardness of the excavation target. The table prestored in the ROM or the like may alternatively be a table showing the correspondence relationship between a combination of the pump discharge pressure, the arm angle β, and the bucket angle γ and the opening area. The boom raising assisting part 301 may alternatively control the opening area of the control valve 177 such that the pump discharge pressure becomes a desired value.

This configuration enables the boom raising assisting part 301 to adjust the details of the boom raising assisting function in accordance with the nature of the excavation target. Therefore, the boom raising assisting part 301 can prevent the rising speed of the boom 4 in the case of lifting soft soil from being excessively high, for example.

Figure 9:
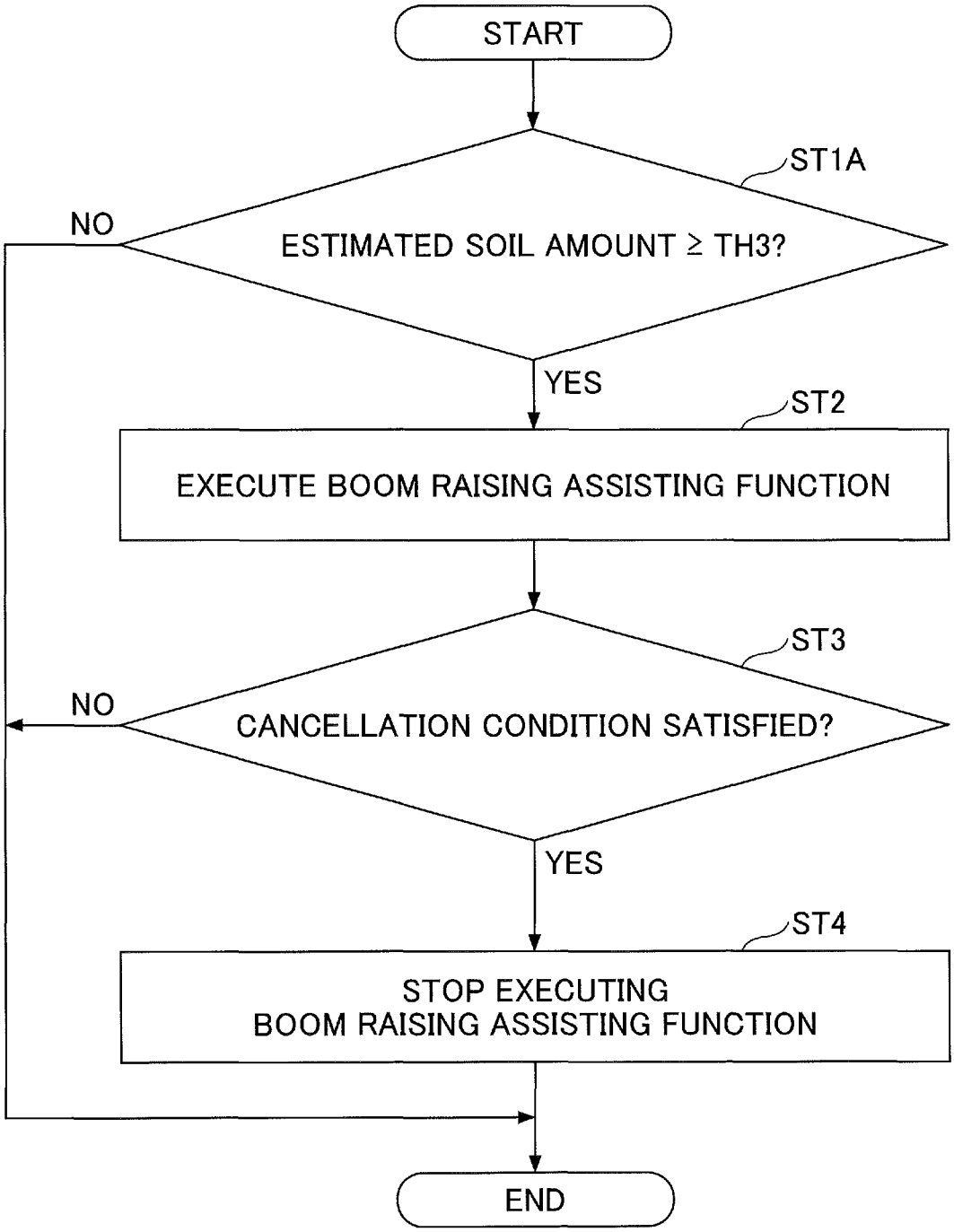
FIG. 9 is a flowchart of still another example of the boom raising assisting process.

Next, still another example of the boom raising assisting process by the boom raising assisting part 301 is described with reference to FIG. 9. FIG. 9 is a flowchart of still another example of the boom raising assisting process. The flowchart of FIG. 9 is different from the flowchart of FIG. 5 in including step ST1A in place of step ST1. Therefore, a description of a common portion is omitted, and differences are described in detail.

According to the boom raising assisting process illustrated in FIG. 9, the boom raising assisting part 301 first determines whether the estimated amount of soil is greater than or equal to a threshold TH3 (step ST1A). In the illustration of FIG. 9, the boom raising assisting part 301 calculates a predicted excavation amount serving as the estimated amount of soil by performing various kinds of image processing on the image of soil in the bucket 6 captured by the camera S6. The boom raising assisting part 301 may calculate the estimated amount of soil based on the output of the information obtaining device. For example, the boom raising assisting part 301 may calculate the estimated amount of soil based on the output of one or more of other information obtaining devices such as the camera S6, a cylinder pressure sensor, a LIDAR, a millimeter wave radar, an inertial measurement unit, etc.

In response to determining that the estimated amount of soil is less than the threshold TH3 (NO at step ST1A), the boom raising assisting part 301 ends the boom raising assisting process of this time without executing the boom raising assisting function. In response to determining that the estimated amount of soil is more than or equal to the threshold TH3 (YES at step ST1A), the boom raising assisting part 301 executes the process at and after step ST2.

This configuration enables the boom raising assisting part 301 to confirm that an excavation target such as soil is accommodated in the bucket 6 and thereafter execute the boom raising assisting function. Accordingly, it is possible to prevent the boom raising assisting function from being executed although no excavation target such as soil is accommodated in the bucket 6.

Figure 10:
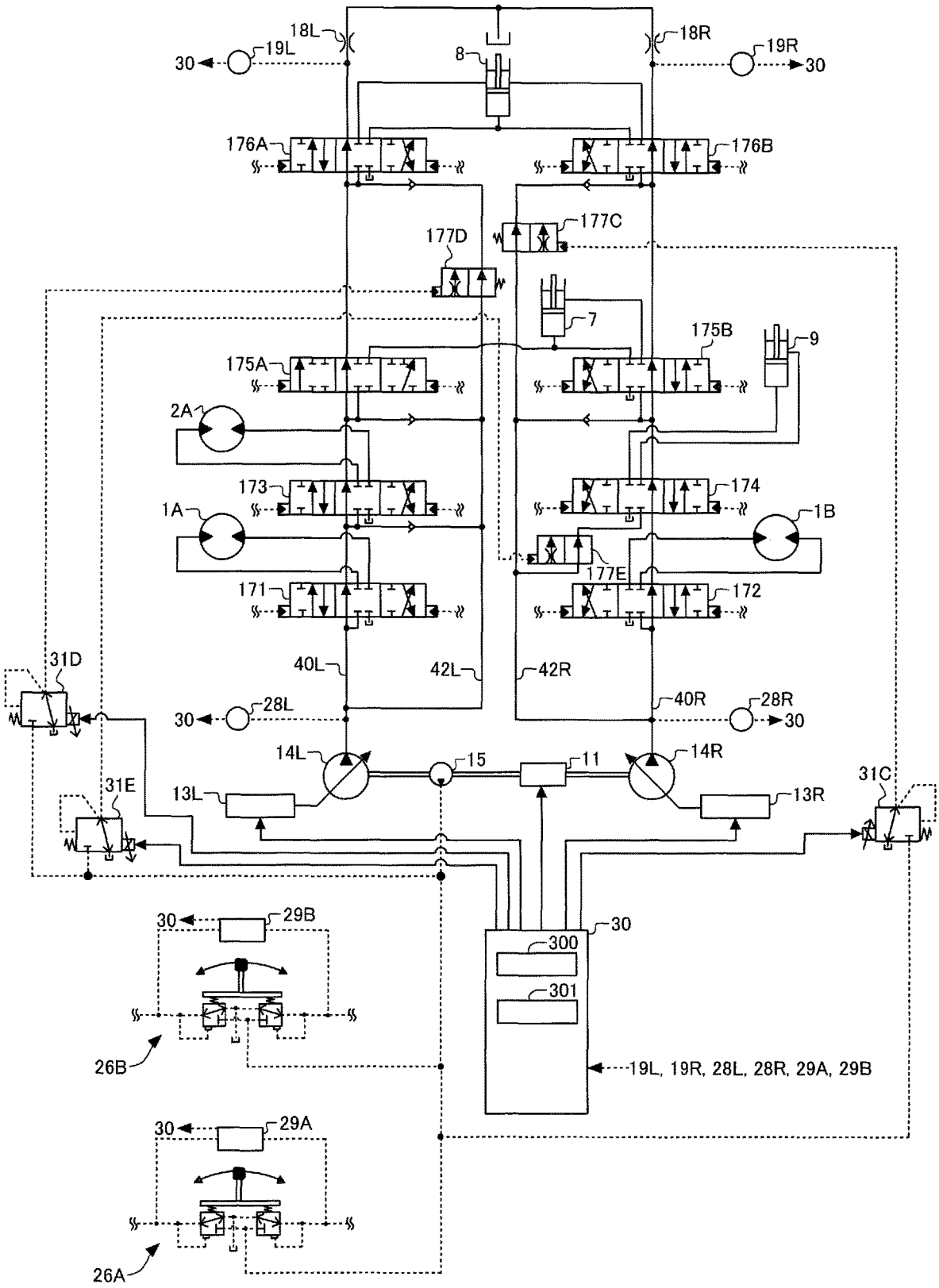
FIG. 10 is a schematic diagram illustrating another example configuration of the hydraulic system installed in the shovel of FIG. 1.

Next, another example configuration of the hydraulic system installed in the shovel of FIG. 1 is described with reference to FIG. 10. FIG. 10 is a schematic diagram illustrating another example configuration of the hydraulic system installed in the shovel of FIG. 1. The hydraulic system of FIG. 10 is different in including control valves 177C through 177E in place of the control valves 177A and 177B and including proportional valves 31C through 31E in place of the proportional valves 31A and 31B from, but otherwise equal to, the hydraulic system of FIG. 3. Therefore, a description of a common portion is omitted, and differences are described in detail.

The control valve 177C is a spool valve that controls the flow rate of hydraulic oil flowing from the main pump 14R into the arm cylinder 8 through the parallel conduit 42R. The control valve 177D is a spool valve that controls the flow rate of hydraulic oil flowing from the main pump 14L into the arm cylinder 8 through the parallel conduit 42L. The control valve 177E is a spool valve that controls the flow rate of hydraulic oil flowing from the main pump 14R into the bucket cylinder 9 through the parallel conduit 42R. The control valves 177C through 177E have a first valve position of a minimum opening area (an opening degree of 0%) and a second valve position of a maximum opening area (an opening degree of 100%). The control valves 177C through 177E can steplessly move between the first valve position and the second valve position.

The proportional valves 31C through 31E adjust a control pressure introduced from the pilot pump 15 to the pilot ports of the control valves 177C through 177E, in response to an electric current command output by the controller 30. The proportional valves 31C through 31E correspond to the proportional valve 31 of FIG. 2.

The proportional valve 31C can adjust the control pressure so that the control valve 177C can stop at any position between the first valve position and the second valve position. The proportional valve 31D can adjust the control pressure so that the control valve 177D can stop at any position between the first valve position and the second valve position. The proportional valve 31E can adjust the control pressure so that the control valve 177E can stop at any position between the first valve position and the second valve position.

In the case of executing the boom raising assisting function, the boom raising assisting part 301 outputs a control command to the proportional valve 31E to reduce the opening area of the control valve 177E. This is for reducing the flow rate of hydraulic oil flowing into the bucket cylinder 9. Likewise, the boom raising assisting part 301 outputs a control command to the proportional valves 31C and 31D to reduce the opening area of the control valves 177C and 177D. This is for reducing the flow rate of hydraulic oil flowing into the arm cylinder 8. As a result, the pressure of hydraulic oil discharged by the main pumps 14L and 14R, namely, the pressure of hydraulic oil that can flow into the boom cylinder 7, increases. Consequently, the shovel can cause hydraulic oil to swiftly flow into the bottom-side oil chamber of the boom cylinder 7 when the boom raising operation is actually performed.

This configuration enables the boom raising assisting part 301 to execute the boom raising assisting function using the hydraulic system of FIG. 10, the same as in the case of executing the boom raising assisting function using the hydraulic system of FIG. 3.

Figure 11:
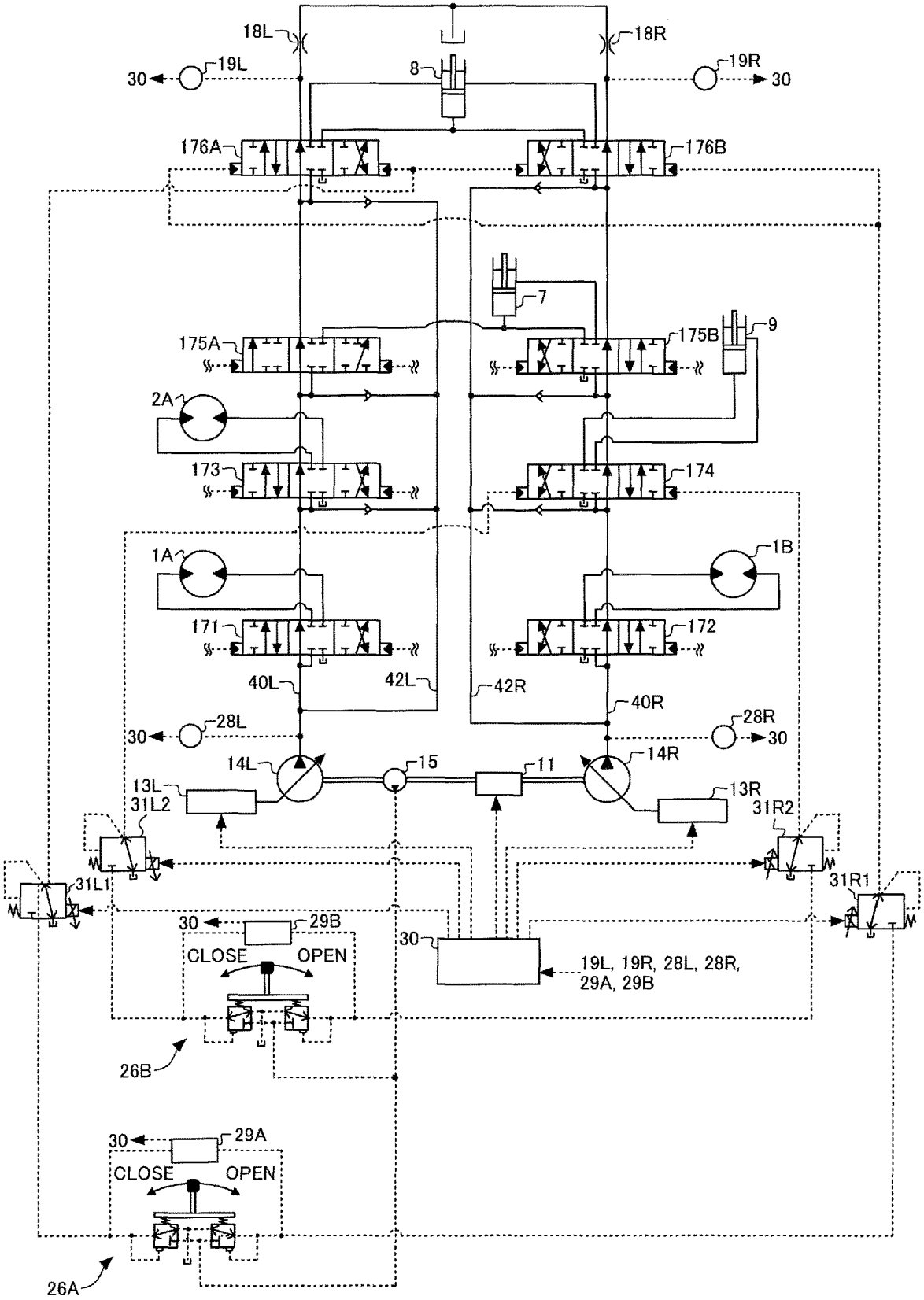
FIG. 11 is a schematic diagram illustrating yet another example configuration of the hydraulic system installed in the shovel of FIG. 1.

Next, yet another example configuration of the hydraulic system installed in the shovel of FIG. 1 is described with reference to FIG. 11. FIG. 11 is a schematic diagram illustrating yet another example configuration of the hydraulic system installed in the shovel of FIG. 1. The hydraulic system of FIG. 11 is different in including proportional valves 31L1, 31L2, 31R1, and 31R2 in place of the proportional valves 31A and 31B and omitting the control valves 177A and 177B from, but otherwise equal to, the hydraulic system of FIG. 3. Therefore, a description of a common portion is omitted, and differences are described in detail.

The proportional valve 31L1 adjusts a pilot pressure introduced from the arm operating lever 26A to the right side pilot port of the control valve 176A and a pilot pressure introduced from the arm operating lever 26A to the left side pilot port of the control valve 176B in response to a control command output by the controller 30. Specifically, the proportional valve 31L1 can adjust a pilot pressure that the arm operating lever 26A generates in response to performance of the arm closing operation.

The proportional valve 31R1 adjusts a pilot pressure introduced from the arm operating lever 26A to the left side pilot port of the control valve 176A and a pilot pressure introduced from the arm operating lever 26A to the right side pilot port of the control valve 176B in response to a control command output by the controller 30. Specifically, the proportional valve 31R1 can adjust a pilot pressure that the arm operating lever 26A generates in response to performance of the arm opening operation.

The proportional valve 31L2 adjusts a pilot pressure introduced from the bucket operating lever 26B to the left side pilot port of the control valve 174 in response to a control command output by the controller 30. Specifically, the proportional valve 31L2 can adjust a pilot pressure that the bucket operating lever 26B generates in response to performance of the bucket closing operation.

The proportional valve 31R2 adjusts a pilot pressure introduced from the bucket operating lever 26B to the right side pilot port of the control valve 174 in response to a control command output by the controller 30. Specifically, the proportional valve 31R2 can adjust a pilot pressure that the bucket operating lever 26B generates in response to performance of the bucket opening operation.

In the case of executing the boom raising assisting function, the boom raising assisting part 301 outputs a control command to the proportional valve 31L1 to reduce a pilot pressure that the arm operating lever 26A generates in response to performance of the arm closing operation, for example, by 30%. This can cause the same situation as in the case where the operator reduces the amount of lever operation of the arm operating lever 26A, namely, returns the arm operating lever 26A to a neutral position, by 30%. Accordingly, the boom raising assisting part 301 can reduce the flow rate of hydraulic oil flowing into the bottom-side oil chamber of the arm cylinder 8 during the arm closing operation without forcing the operator to perform an operation to return the arm operating lever 26A to a neutral position.

Furthermore, the boom raising assisting part 301 outputs a control command to the proportional valve 31R1 to reduce a pilot pressure that the arm operating lever 26A generates in response to performance of the arm opening operation. Accordingly, the boom raising assisting part 301 can reduce the flow rate of hydraulic oil flowing into the rod-side oil chamber of the arm cylinder 8 during the arm opening operation without forcing the operator to perform an operation to return the am operating lever 26A to a neutral position.

Furthermore, the boom raising assisting part 301 outputs a control command to the proportional valve 31L2 to reduce a pilot pressure that the bucket operating lever 26B generates in response to performance of the bucket closing operation. Accordingly, the boom raising assisting part 301 can reduce the flow rate of hydraulic oil flowing into the bottom-side oil chamber of the bucket cylinder 9 during the bucket closing operation without forcing the operator to perform an operation to return the bucket operating lever 26B to a neutral position.

Furthermore, the boom raising assisting part 301 outputs a control command to the proportional valve 31R2 to reduce a pilot pressure that the bucket operating lever 26B generates in response to performance of the bucket opening operation. Accordingly, the boom raising assisting part 301 can reduce the flow rate of hydraulic oil flowing into the rod-side oil chamber of the bucket cylinder 9 during the bucket opening operation without forcing the operator to perform an operation to return the bucket operating lever 26B to a neutral position.

As a result, the pressure of hydraulic oil discharged by the main pumps 14L and 14R, namely, the pressure of hydraulic oil that can flow into the boom cylinder 7, increases. Consequently, the shovel can cause hydraulic oil to swiftly flow into the bottom-side oil chamber of the boom cylinder 7 when the boom raising operation is actually performed.

This configuration enables the boom raising assisting part 301 to execute the boom raising assisting function using the hydraulic system of FIG. 11, the same as in the case of executing the boom raising assisting function using the hydraulic system of FIG. 3.

As described above, according to the shovel of this embodiment, the controller 30 increases the pressure of hydraulic oil that can flow into the boom cylinder 7 in accordance with information on the attachment before the boom raising operation is performed. Therefore, the boom raising motion can be smoother during excavation.

The controller 30 desirably increases the pressure of hydraulic oil that can flow into the boom cylinder 7 with the timing determined based on information on the attachment obtained by the information obtaining device before the boom raising operation is performed. The timing is, for example, such that the bucket 6 is filled with soil when the boom raising operation is actually performed. Therefore, the pressure of hydraulic oil that can flow into the boom cylinder 7 can be increased with more appropriate timing.

The controller 30 desirably reduces the flow rate of hydraulic oil flowing into or out of each of the arm cylinder 8 and the bucket cylinder 9 before the boom raising operation is performed. Therefore, the pressure of hydraulic oil that can flow into the boom cylinder 7 can be increased in a simple and reliable manner.

Desirably, when the boom raising operation is not performed even after a predetermined period of time passes since increasing the pressure of hydraulic oil that can flow into the boom cylinder 7, the controller 30 reduces the increased pressure. Therefore, it is possible to prevent the flow rate of hydraulic oil flowing into or out of each of the arm cylinder 8 and the bucket cylinder 9 from continuing to be restricted for a long period of time in spite of the absence of performance of the boom raising operation.

An embodiment of the present invention is described in detail above. The present invention, however, is not limited to the above-described embodiment, and variations, replacements, etc., may be applied to the above-described embodiment without departing from the scope of the present invention. Furthermore, separately described features may be combined as long as no technical contradiction arises.

What is claimed is:

1. A shovel comprising:

a lower traveling body;

an upper turning body turnably mounted on the lower traveling body;

a cab mounted on the upper turning body;

an attachment including a boom attached to the upper turning body;

a boom cylinder configured to drive the boom;

a hydraulic pump configured to supply hydraulic oil to the boom cylinder through a conduit;

a hardware processor configured to control hydraulic oil flowable into the boom cylinder; and an information obtaining device configured to obtain information on the attachment, wherein the hardware processor is configured to increase a pressure of the hydraulic oil flowable into the boom cylinder in accordance with the information on the attachment before a boom raising operation is performed.

2. The shovel as claimed in claim 1, wherein the hardware processor is configured to increase the pressure of the hydraulic oil flowable into the boom cylinder with timing determined based on the information on the attachment before the boom raising operation is performed, and the timing is such that a bucket is filled with soil when the boom raising operation is actually performed.

3. The shovel as claimed in claim 1, wherein the information obtaining device includes at least one of a camera configured to capture an image of an inside of a bucket, an angle sensor attached to the attachment, and a cylinder pressure sensor configured to detect a pressure of hydraulic oil in a hydraulic cylinder configured to drive the attachment.

4. The shovel as claimed in claim 1, wherein the hardware processor is configured to reduce a flow rate of hydraulic oil flowing into or out of each of an arm cylinder and a bucket cylinder before the boom raising operation is performed.

5. The shovel as claimed in claim 1, wherein the hardware processor is configured to, in response to absence of performance of the boom raising operation even after a predetermined period of time passes since the pressure of the hydraulic oil flowable into the boom cylinder is increased, reduce the increased pressure.

6. The shovel as claimed in claim 1, wherein the hardware processor is configured to increase a pressure of hydraulic oil flowable into a turning hydraulic motor when an operation related to an arm cylinder and an operation related to the turning hydraulic motor are performed.

7. The shovel as claimed in claim 1, wherein the hardware processor is configured to increase the pressure of the hydraulic oil flowable into the boom cylinder when the boom raising operation and an operation related to a turning hydraulic motor are performed.

8. The shovel as claimed in claim 1, wherein the hardware processor is configured to increase the pressure of the hydraulic oil flowable into the boom cylinder in accordance with the information on the attachment over a predetermined period before a start of the boom raising operation such that the pressure of the hydraulic oil flowable into the boom cylinder is increased when the boom raising operation is performed.

9. The shovel as claimed in claim 1, further comprising:

a control valve placed in the conduit, wherein the conduit is connected to a hydraulic tank, and the hardware processor is configured to increase the pressure of the hydraulic oil flowable into the boom cylinder by increasing a discharge pressure of the hydraulic pump by controlling an opening area of the control valve, in accordance with the information on the attachment before the boom raising operation is performed.

10. The shovel as claimed in claim 9, wherein the hardware processor is configured to increase the discharge pressure of the hydraulic pump by reducing the opening area of the control valve.

11. The shovel as claimed in claim 1, wherein the information obtaining device includes at least one of a camera, a sensor, a LIDAR, a millimeter wave radar, and an inertial measurement unit.

* * * * *